US006202455B1

(12) United States Patent
Su

(10) Patent No.: US 6,202,455 B1
(45) Date of Patent: Mar. 20, 2001

(54) ZIPPER LOCK ASSEMBLY FOR AN ARTICLE WITH A ZIPPER HAVING TWO PULL TABS

(76) Inventor: Shun-Chang Su, P.O. Box 63-247, Taichung (TW)

( * ) Notice: Subject to any disclaimer, the term of this patent is extended or adjusted under 35 U.S.C. 154(b) by 0 days.

(21) Appl. No.: 09/491,076

(22) Filed: Jan. 24, 2000

(51) Int. Cl.[7] ..... E05B 37/12; E05B 67/38

(52) U.S. Cl. ..... 70/68; 70/312

(58) Field of Search ..... 70/67–69, 71, 70/312, 316, 317

(56) References Cited

U.S. PATENT DOCUMENTS 4,884,419 * 12/1989 Ling ..... 70/68 X
5,557,954 * 9/1996 Ling ..... 70/68
5,689,979 * 11/1997 Yu ..... 70/68 X
5,927,110 * 7/1999 Yu ..... 70/68
6,065,313 * 5/2000 Huang ..... 70/68

FOREIGN PATENT DOCUMENTS

969895 * 12/1950 (FR) ..... 70/67
1239511 * 7/1960 (FR) ..... 70/67
463145 * 4/1951 (IT) ..... 70/67

* cited by examiner

*Primary Examiner*—Lloyd A. Gall
(74) *Attorney, Agent, or Firm*—Alan Kamrath; Rider Bennett Egan & Arundel, LLP.

(57) ABSTRACT

A zipper lock assembly is provided for an article with a zipper having two pull tabs. The zipper lock assembly includes a casing having two compartments and two slots for intercommunicating the compartments with outside to allow respective passing of the pull tabs into the compartment. A number lock assembly includes several number wheels rotatably mounted in the casing and a slide plate mounted in the casing and movable in a lateral direction in response to rotational movement of the number wheels. A follower member is releasably engaged with the slide plate. Two push members are pivotally mounted in the casing and each includes a first end for manual operation and a second end with a locking piece and a lug. When the number wheels of the number lock assembly are not in correct code number for unlocking, engagement of the follower member with the slide plate as well as pivotal movement of the push members are prevented to retain the locking piece in the compartment for retaining the pull tabs in place. When the number wheels of the number lock assembly are in the correct code number for unlocking, the follower member is allowed to engage with the slide plate upon pivotal movement of the push members by manually pressing the first ends of the push members, thereby disengaging the locking piece from the pull tabs and thus allowing removal of the pull tabs.

17 Claims, 6 Drawing Sheets

ZIPPER LOCK ASSEMBLY FOR AN ARTICLE WITH A ZIPPER HAVING TWO PULL TABS

BACKGROUND OF THE INVENTION

1. Field of the Invention

The present invention relates to a zipper lock assembly for an article, e.g., a trunk, with a zipper having two pull tabs, and more particularly to a zipper lock assembly that allows auto-ejection of the pull tabs and easy resetting in the code number for unlocking.

2. Description of the Related Art

A conventional zipper lock assembly generally includes a casing with a tie rod onto which two pull tabs of a zipper of a trunk or the like are tied up in an overlapped manner. The tie rod with pull tabs tied up thereon is pressed and a follower member is moved inward to a locked position after the number wheels mounted to the casing are turned to a position other than the correct number code position. Nevertheless, it is found that the pull tabs may not be overlapped for locking if they are too short. Removal of the pull tabs from the tie rod is inconvenient, as the user must remove them one by one. The pull tabs might even be stuck on the tie rod.

SUMMARY OF THE INVENTION

It is a primary object of the present invention to provide a zipper lock assembly that allows easy removal and insertion of the two pull tabs of a zipper on an article (e.g., a trunk) to be locked. The pull tabs are ejected outward automatically after the number wheels of the zipper lock assembly are turned to the correct code position and two press members are pressed inward. Resetting of the code number is easily achieved by turning the number wheels while keeping the press members in the pressed position.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
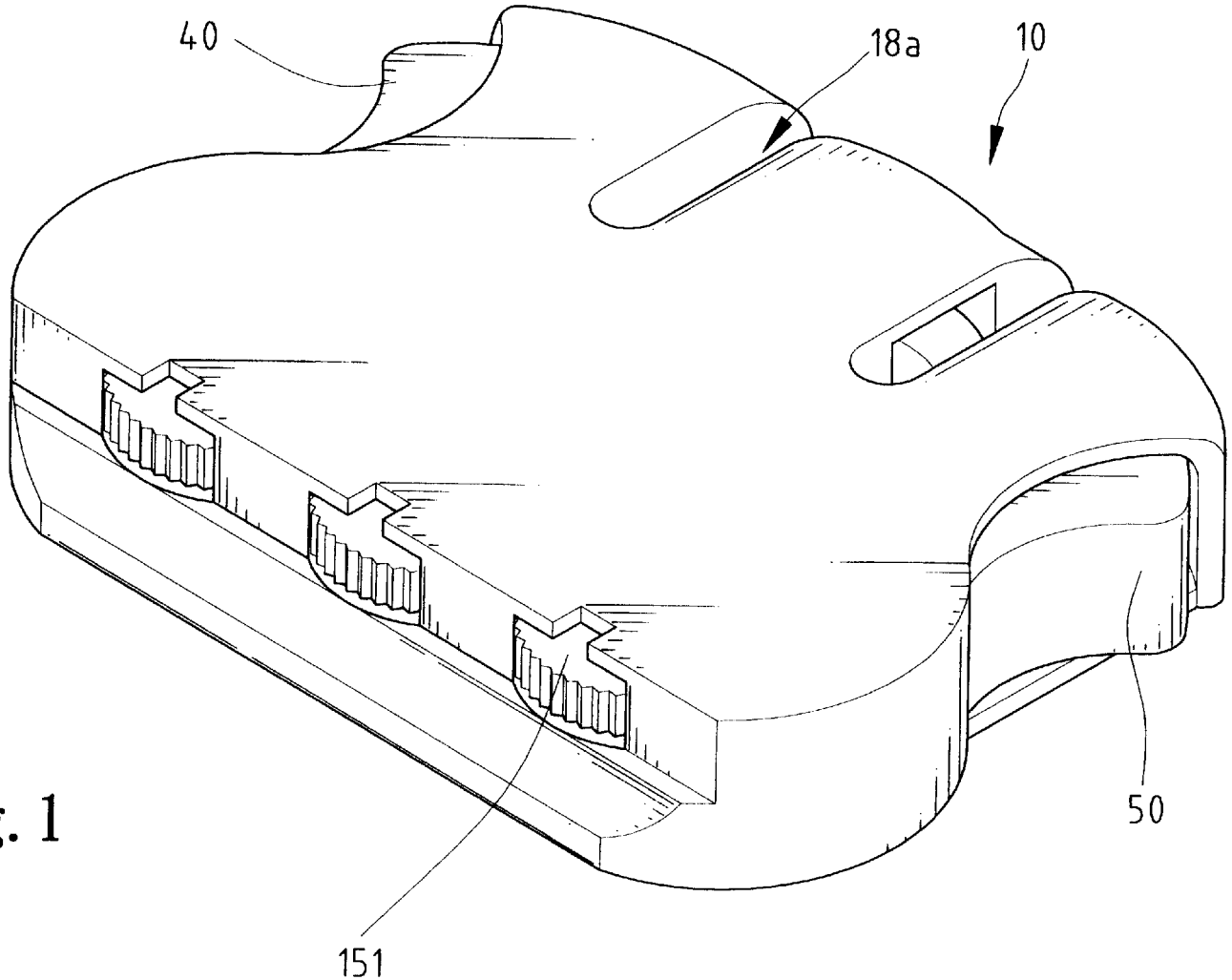
FIG. 1 is a perspective view of a zipper lock assembly in accordance with the present invention.
Figure 2:
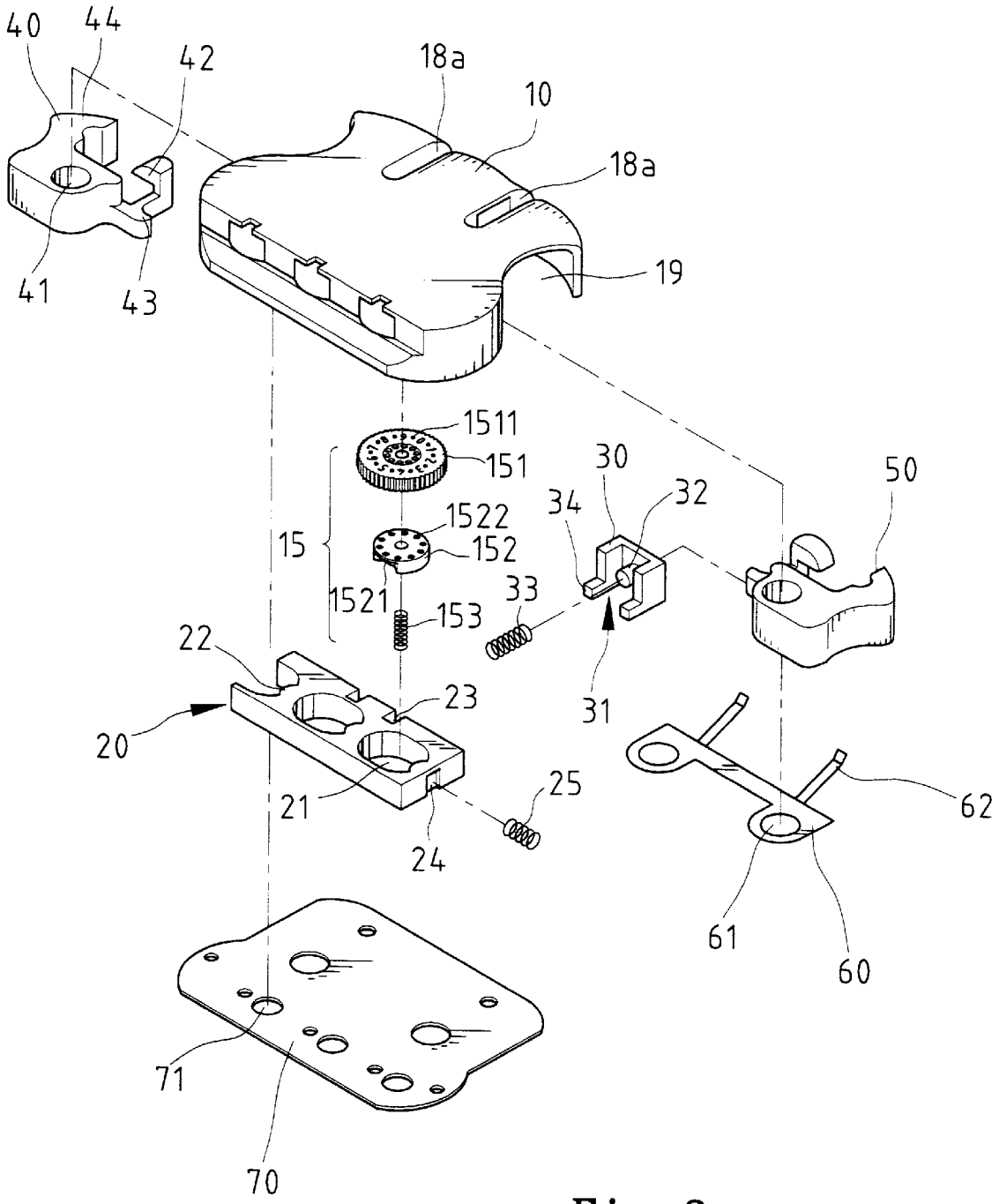
FIG. 2 is an exploded perspective view of the zipper lock assembly device in accordance with the present invention.

Referring to FIGS. 1 through 6 and initially to FIGS. 1 and 2, a zipper lock assembly in accordance with the present invention is provided for an article (e.g., a trunk) having a zipper with two pull tabs 80 (FIG. 4) and generally includes a casing 10, a slide plate 20, a follower member 30, two push members 40 and 50, a resilient member 60, and a bottom plate 70.

Figure 3:
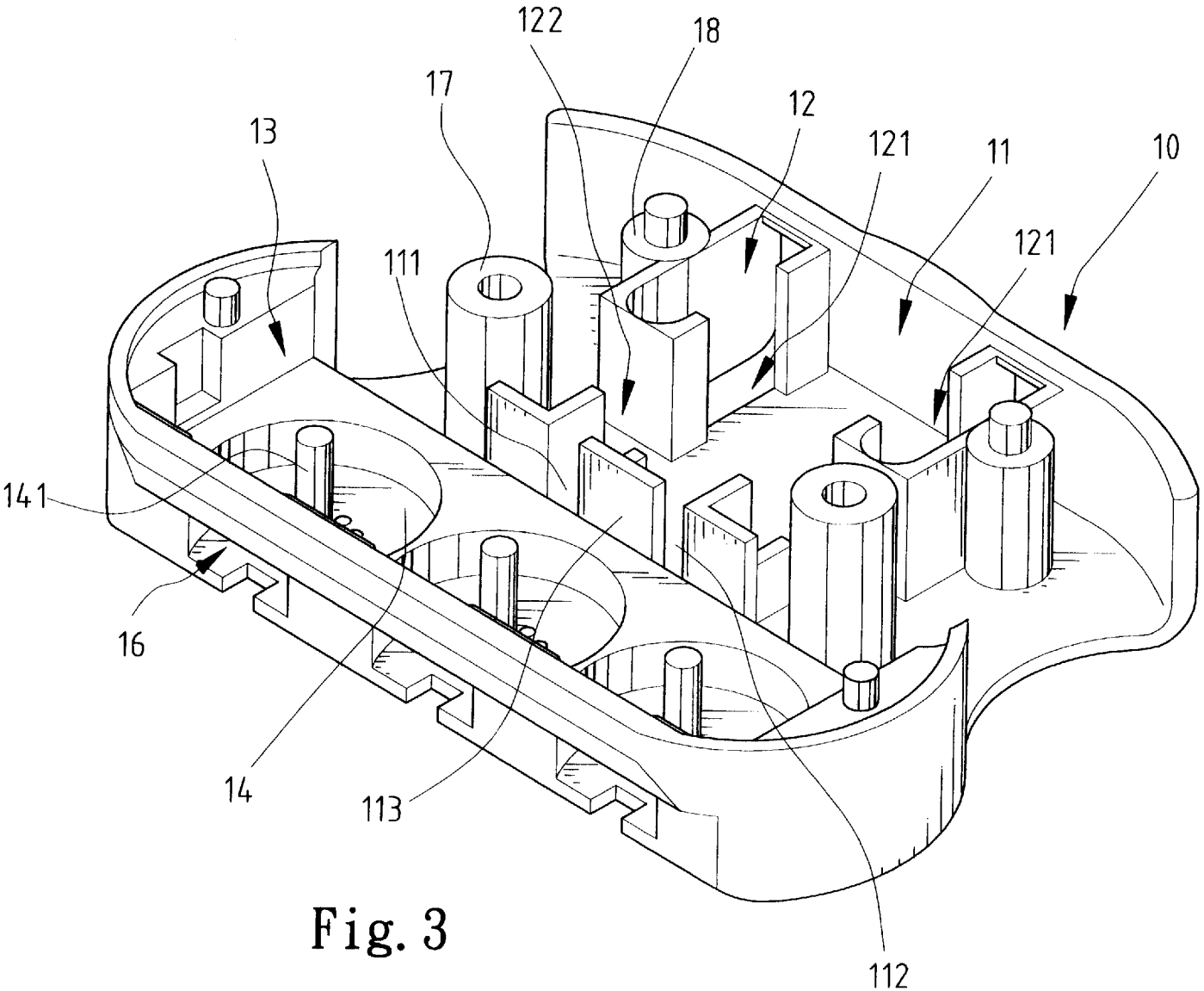
FIG. 3 is a bottom perspective view, in an enlarged scale, of a casing of the zipper lock assembly in accordance with the present invention.

As illustrated in FIGS. 2 and 3, the casing 10 includes two slots 18*a* in a first side thereof and three slots 16 in a second side 13 thereof. A first compartment 11 is defined in the first side of the casing 10. Two second compartments 12 are provided adjacent to two ends of the first compartment 11 and communicated with the first compartment 11 by opening or passages 121, respectively. Each second compartment 12 is communicated with outside via an associated slot 18*a*.

Three number wheel compartments 14 are provided in the second side 13 of the casing 10 and each includes an axle 141 for rotatably mounting a number wheel 151, a retaining wheel 152, and an elastic member 153. Two guide grooves 111 and 112 are defined in a mediate portion of the casing 1 and spaced by a separation member 113 (FIG. 3). The casing 10 further includes passages 122 (FIG. 3) adjacent to the compartments 12, which will be described later.

Figure 4:
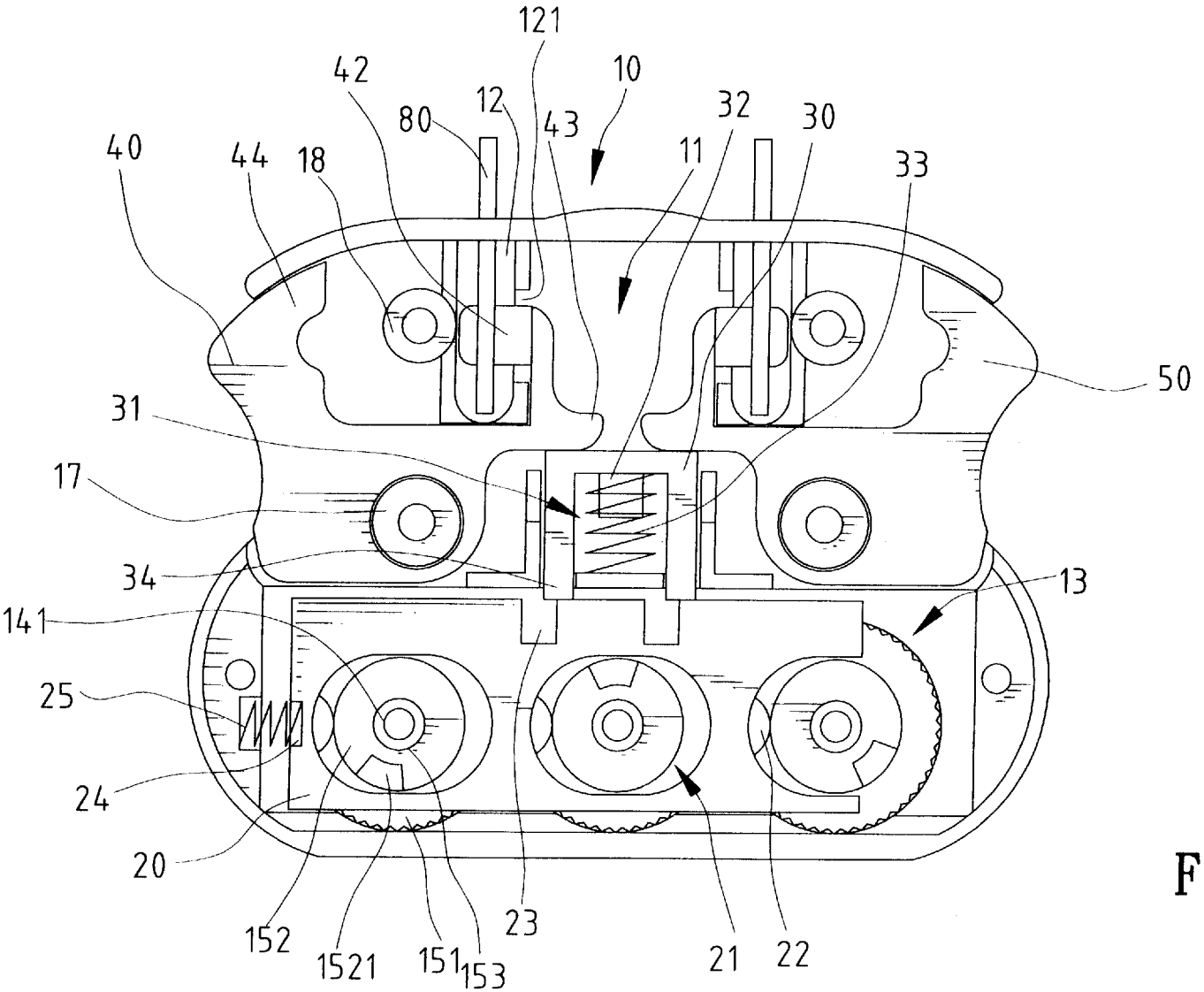
FIG. 4 is a bottom view of the zipper lock assembly with a bottom plate removed to show inner structure, wherein the zipper lock is a locked status.

As illustrated in FIGS. 2 and 4, each retaining wheel 152 includes a notch 1521 in a periphery thereof and a plurality of annularly spaced knurls 1522 on an upper side thereof. Each number wheel 151 includes a plurality of numbers (e.g., 0~9) on an upper side thereof and a plurality of depressions 1511 on a lower side thereof. The knurls 1522 of the retaining wheel 152 are biased by the elastic member 153 to releasably engage with the depressions 1511 of the number wheel 151 for providing a retaining effect. The number wheels 151, retaining wheels 152, and elastic members 153 together form a number wheel assembly 15. Each slot 16 of the casing 10 is communicated with an associated number wheel compartment 14 such that a portion of the number wheel 151 is exposed via the slot 16 to show the number formed on the upper side of the number wheel 151. In assembly, a elastic member 153, a retaining wheel 152, and a number wheel 151 are mounted on an axle 141 to allow rotation of the number wheel 151, which will be described later.

The slide plate 20 is substantially rectangular and includes three openings 21 each having a protrusion 22 on an inner periphery thereof. The slide plate 20 is mounted in the second side of the casing 10 and covers undersides of the number wheels 151 with the retaining wheels 152 rotatably received in the openings 21, respectively. The protrusion 22 is provided to releasably engage with the notch 1521 of an associated retaining wheel 152. A spring 25 is provided to a side of the slide plate 20. The slide plate 20 further includes a pair of engaging notches 23, which will be described later.

The follower member 30 is substantially U-shaped and includes two legs 34 and a mediate portion. The follower member 30 is mounted in the mediate portion of the casing 10. A stub 32 is formed on an inner side of the mediate portion of the follower member 30 and an elastic member (e.g., a spring 33) is attached between the stub 32 and the separation member 113 between the guide grooves 111 and 112 for biasing the legs 34 of the follower member 30 away from the guide grooves 111 and 112.

As illustrated in FIGS. 2 through 4, the push members 40 and 50 are arranged in a symmetric manner and each includes a pivotal hole 41 so as to be pivotally mounted to a peg 17 formed in the casing 10. Each push member 40, 50 includes a first end 44 exposed outside the casing 10 (via side opening 19, see FIG. 2) for manual push operation and a second end with a locking piece 42 and a lug 43. The locking piece 42 is provided for retaining an associated pull tab 80 in place when the number wheels 151 are not in the correct code number position. The lug 43 is operably connected to the follower member 30 for pressing the follower member 30 to an unlocking position to allow removal of the pull tab 80, which will be described in detail later.

The resilient member 60 is a thin plate having a hole 61 in each end thereof through which an associated peg 17 extends. The resilient member 60 further includes two resilient legs 62 projected outward from a side thereof and at an angle with the side, each resilient leg 62 being substantially L-shape and having a distal end. The resilient legs 62 are extended into in the compartments 12 of the casing 10.

The bottom plate 70 is releasably attached to enclose a bottom of the casing 10 and includes a plurality of holes 71 through which the pegs 17 and engaging pegs 18 of the casing 10 extend.

Figure 5:
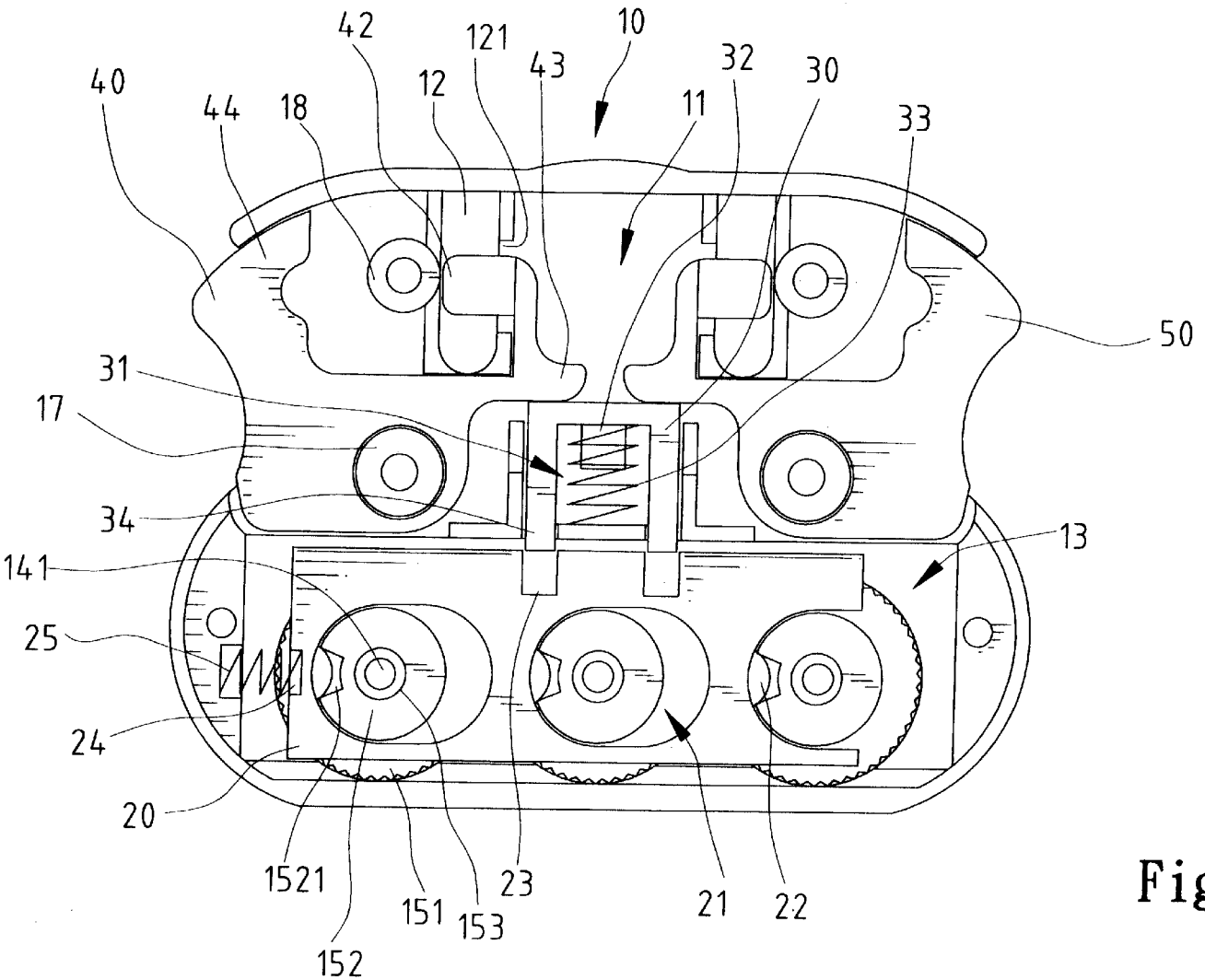
FIG. 5 is a view similar to FIG. 4, wherein a number lock assembly of the zipper lock assembly is in an unlocked status.
Figure 6:
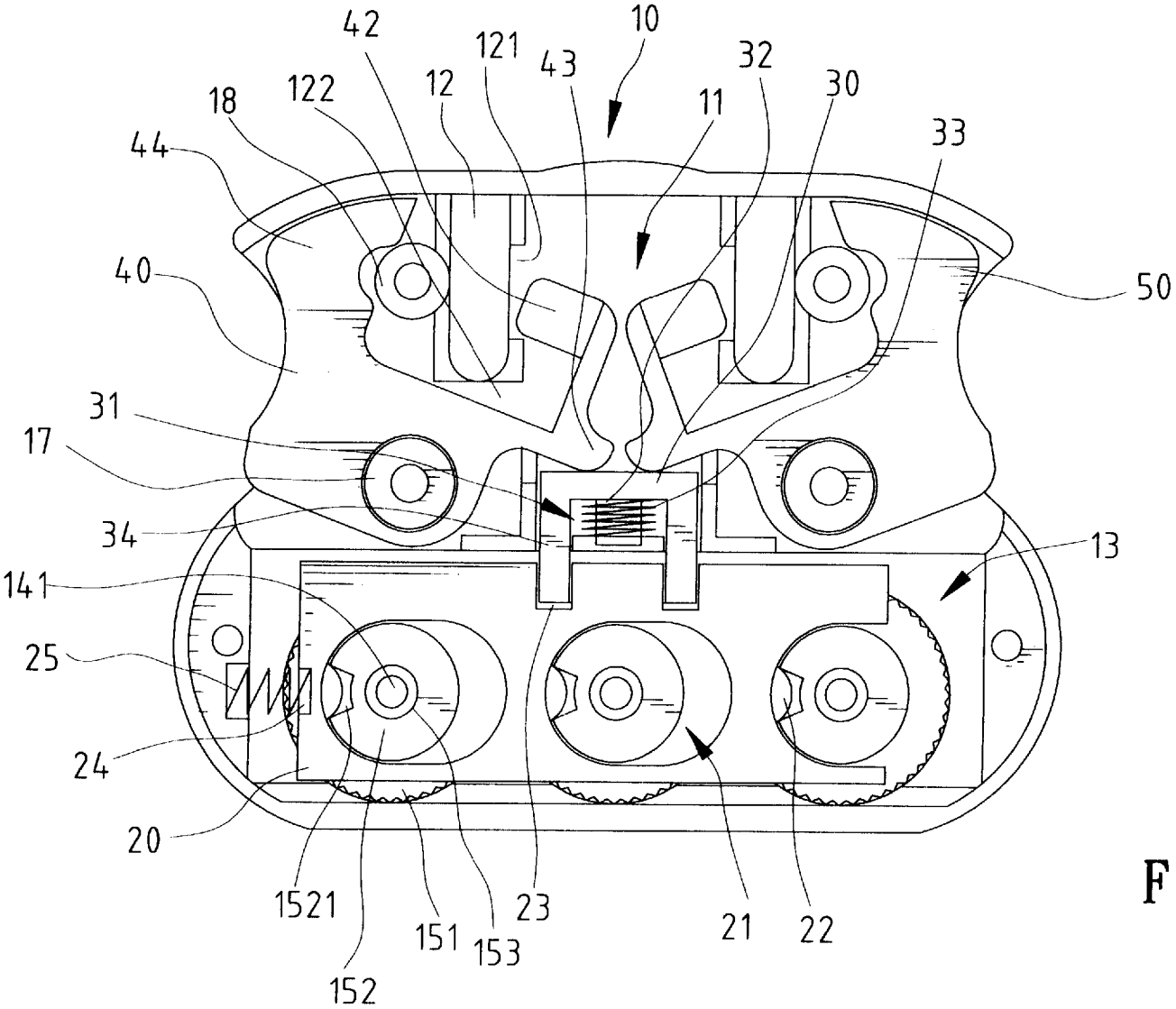
FIG. 6 is a view similar to FIG. 4, wherein the zipper lock assembly is in a status for resetting or allowing removal/insertion of the pull tabs of a zipper.

In use, the number wheels 151 are turned to the correct code number position shown in FIG. 5. The protrusions 22 of the slide plate 20 are received in the notches 1521 of the retaining wheels 152. It is noted that the slide plate 20 is moved to a position in which the engaging notches 23 of the slide plate 20 are aligned with the legs 34 of the follower member 30. The pressing members 40 and 50 are pressed at the first ends 44 thereof to pivot about the pegs 17. As illustrated in FIG. 6, the lugs 43 of the push members 40 and 50 urge the legs 34 of the follower member 30 into the engaging notches 23 and compress the spring 33. The locking piece 42 of the push members 40 and 50 are moved out of the compartments 12 of the casing 10. The pull tabs 80 of a zipper of an article (e.g., a trunk) are respectively inserted into the compartments 12 of the casing 10 via the slots 18*a*, the push members 40 and 50 are then released such that the locking pieces 42 are moved back into the compartments 12 under the action of the spring 33, and the number wheels 151 are then turned to a position other than the correct code number position to move the slide plate 20 to a position in which the engaging notches 23 of the slide plate 20 are not aligned with the legs 34 of the follower member 30, best shown in FIG. 4. Rotational movement of the retaining wheels 152 as a result from rotation of the number wheels 151 causes sliding of the slide plate 20, as side walls defining the notches 1521 of the retaining wheels 152 exert centrifugal force to the protrusions 22 of the slide plate 22. Thus, the pull tabs 80 are retained in place by the locking pieces 42 to provide the required locking function. It is noted that the pull tabs 80 in the locked position compress the resilient legs 62. When unlocking is required, the number wheels 151 are turned to the correct code position and the press members 40 and 50 are pressed inward to release the pull tabs 80. It is noted that the resilient legs 62 eject the pull tabs 80 when the locking pieces 42 are moved out of the compartments 12 of the casing 10.

Referring to FIG. 6, when in the unlocking position, resetting of the code number can be proceeded by means of turning the number wheels 151, as the retaining wheels 152 are retained in place by the protrusions 22 of the slide plate 20 and thus will not rotate together with the number wheels 151. In addition to the retaining effect, re-engagement of the knurls 1522 of the retaining wheel 152 into the depressions 1511 of the number wheel 151 generates a sound "kaka" to remind the user of the change in the position of the number wheels 151.

It is appreciated that the casing 10 may have only one compartment 12 and one slot 18*a*, and there is only one push member accordingly. In this case, both pull tabs 80 are inserted into the compartment 12 via the slot 18*a* so as to be retained in place by the locking piece of the push member.

According to the above description, it is appreciated that the pull tabs of a zipper of an article are reliably retained in place and the locking procedure is easy. In addition, the pull tabs can be ejected automatically when unlocked. Resetting of the number lock assembly 15 can be easily achieved.

Although the invention has been explained in relation to its preferred embodiment, it is to be understood that many other possible modifications and variations can be made without departing from the spirit and scope of the invention as hereinafter claimed.

What is claimed is:

1. A zipper lock assembly for an article with a zipper having two pull tabs, comprising:

a casing including a compartment, the casing further including a slot for intercommunicating the compartment with outside to allow passing of the pull tabs into the compartment;

a number lock assembly including a plurality of number wheels rotatably mounted in the casing and a slide plate mounted in the casing and movable in a lateral direction in response to rotational movement of the number wheels;

a follower member releasably engaged with the slide plate; and a push member pivotally mounted in the casing and including a first end for manual operation and a second end with a locking piece and a lug, the lug being operably connected to the follower member;

whereby when the number wheels of the number lock assembly are not in correct code number for unlocking, engagement of the follower member with the slide plate as well as pivotal movement of the push member are prevented to retain the locking piece in the compartment for retaining the pull tabs in place, whereby when the number wheels of the number lock assembly are in the correct code number for unlocking, the follower member is allowed to engage with the slide plate upon pivotal movement of the push member by manually pressing the first end of the push member, thereby disengaging the locking piece from the pull tabs and thus allowing removal of the pull tabs.

2. The zipper lock assembly as claimed in claim 1, further comprising a resilient member mounted in the compartment, the resilient member being compressed by the pull tabs when the pull tabs are locked in the compartment such that the pull tabs are ejected out of the casing by the resilient member when the locking piece is disengaged from the pull tabs.

3. The zipper lock assembly as claimed in claim 1, further comprising an elastic member mounted in the casing for biasing the follower member to a position adjacent to the lug of the push member.

4. A zipper lock assembly for an article with a zipper having two pull tabs, comprising:

a casing including two compartments, the casing further including two slots for intercommunicating the compartments with outside to allow respective passing of the pull tabs into the compartments;

a number lock assembly including a plurality of number wheels rotatably mounted in the casing and a slide plate mounted in the casing and movable in a lateral direction in response to rotational movement of the number wheels, the slide plate including two engaging notches;

a follower member including two legs releasably engaged with the engaging notches of the slide plate; and two push members pivotally mounted in the casing and each including a first end for manual operation and a second end with a locking piece and a lug, the lug being operably connected to the follower member, the locking piece being movable between a first position in an associated said compartment for engaging with an associated said pull tab of the zipper and a second position disengaging from the associated pull tab of the zipper upon manual pressing on the first end of the push member;

whereby when the number wheels of the number lock assembly are not in correct code number for unlocking, engagement of the legs of the follower member with the engaging notches of the slide plate as well as pivotal movement of the push members are prevented to retain the locking pieces in the compartments for retaining the pull tabs in place, whereby when the number wheels of the number lock assembly are in the correct code number for unlocking, the lugs of the push members urge the legs of the follower member to engage with the engaging notches of the slide plate upon pivotal movement of the push members by manually pressing the first ends of the push members, thereby disengaging the locking pieces from the pull tabs and thus allowing removal of the pull tabs.

5. The zipper lock assembly as claimed in claim 4, further comprising a resilient member mounted in each said compartment, the resilient member being compressed by the associated pull tab when the associated pull tab is locked in the compartment such that the pull tab is ejected out of the casing when an associated said locking piece is disengaged from the pull tab.

6. A zipper lock assembly for an article with a zipper having two pull tabs, comprising:

a casing including two compartments, the casing further including two slots for intercommunicating the compartments with outside to allow respective passing of the pull tabs into the compartments;

a number lock assembly including a plurality of number wheels rotatably mounted in the casing, a plurality of retaining wheels respectively and releasably engaging with the number wheels to rotate therewith, and a slide plate mounted in the casing and movable in a lateral direction in response to rotational movement of the retaining wheels, the slide plate including two engaging notches;

a follower member including two legs releasably engaged with the engaging notches of the slide plate; and two push members pivotally mounted in the casing and each including a first end for manual operation and a second end with a locking piece and a lug, the lug being operably connected to the follower member, the locking piece being movable between a first position in an associated said compartment for engaging with an associated said pull tab of the zipper and a second position disengaging from the associated pull tab of the zipper upon manual pressing on the first end of the push member;

whereby when the number wheels of the number lock assembly are not in correct code number for unlocking, engagement of the legs of the follower member with the engaging notches of the slide plate as well as pivotal movement of the push members are prevented to retain the locking pieces in the compartments for retaining the pull tabs in place, whereby when the number wheels of the number lock assembly are in the correct code number for unlocking, the lugs of the push members urge the legs of the follower member to engage with the engaging notches of the slide plate upon pivotal movement of the push members by manually pressing the first ends of the push members, thereby disengaging the locking pieces from the pull tabs and thus allowing removal of the pull tabs.

7. The zipper lock assembly as claimed in claim 6, further comprising a resilient member mounted in each said compartment, the resilient member being compressed by the associated pull tab when the associated pull tab is locked in the compartment such that the pull tab is ejected out of the casing when an associated said locking piece is disengaged from the pull tab.

8. The zipper lock assembly as claimed in claim 6, wherein the slide plate includes three openings for rotatably receiving the retaining wheels, respectively, an inner periphery defining each said opening including a protrusion, each said retaining wheel including a notch releasably engaged with the protrusion of an associated said opening of the slide plate, whereby when the number wheels are in the correct code number position, the notch of each said retaining wheel is engaged with the protrusion with the associated opening of the slide plate while the engaging notches of the slide plate being aligned with the legs of the follower member, and when the number wheels are not in the correct code number position, the notch of each said retaining wheel is not engaged with the protrusion with the associated opening of the slide plate while the engaging notches of the slide plate being not aligned with the legs of the follower member.

9. The zipper lock assembly as claimed in claim 8, wherein the casing includes a plurality of axles each for mounting an associated said number wheel and an associated said retaining wheel thereon, each said number wheel including a plurality of depressions in a side thereof, each said retaining wheel being rotatably mounted on an associated said number wheel, each said retaining wheel including a corresponding number of knurls formed on a side thereof for releasably engaging with depressions of the associated number wheel to provide a retaining effect.

10. The zipper lock assembly as claimed in claim 9, further comprising an elastic member mounted on each said axle for biasing the associated retaining wheel to engage with the associated number wheel to rotate therewith.

11. The zipper lock assembly as claimed in claim 6, wherein the casing includes three number wheel compartments for rotatably receiving the number wheels, respectively, the casing further including three second slots that are respectively communicated with the number wheel compartments such that each said number wheel is partially exposed for manual turning.

12. The zipper lock assembly as claimed in claim 6, further comprising means for biasing the slide plate in the sliding direction of the slide plate.

13. The zipper lock assembly as claimed in claim 6, wherein the follower member includes a peg, the casing including two guide grooves for receiving the legs of the follower member, the guide grooves being separated by a separation member, further comprising an elastic member attached between the peg of the follower member and the separation member for biasing the legs of the follower member away from the engaging notches of the slide plate.

14. The zipper lock assembly as claimed in claim 13, wherein the slide plate includes three openings for receiving the retaining wheels, respectively, an inner periphery defining each said opening including a protrusion, each said retaining wheel including a notch releasably engaged with the protrusion of an associated said opening of the slide plate, whereby when the number wheels are in the correct code number position, the notch of each said retaining wheel is engaged with the protrusion with the associated opening of the slide plate while the engaging notches of the slide plate being aligned with the legs of the follower member, and when the number wheels are not in the correct code number position, the notch of each said retaining wheel is not engaged with the protrusion with the associated opening of the slide plate while the engaging notches of the slide plate being not aligned with the legs of the follower member.

15. The zipper lock assembly as claimed in claim 14, wherein each said number wheel includes a plurality of depressions in a side thereof, each said retaining wheel being rotatably mounted on an associated said number wheel, each said retaining wheel including a corresponding number of knurls formed on a side thereof for releasably engaging with the depressions of the associated number wheel to provide a retaining effect.

16. The zipper lock assembly as claimed in claim 6, further comprising a resilient plate having two resilient legs extended into the compartments, respectively, each said resilient leg being compressed by an associated said pull tab when the associated pull tab is locked in the compartment such that the pull tab is ejected out of the casing when an associated said locking piece is disengaged from the pull tab.

17. The zipper lock assembly as claimed in claim 16, wherein the casing includes two pegs to which the push members are pivotally mounted, respectively, the resilient plate including two holes through which the pegs of the casing are extended.

* * * * *